US005305608A

United States Patent [19]

Loving

[11] Patent Number: 5,305,608

[45] Date of Patent: Apr. 26, 1994

[54] LIQUID FUEL POWER PLANT AND METHOD

[75] Inventor: Ronald E. Loving, Simi Valley, Calif.

[73] Assignee: Hughes Aircraft Company, Los Angeles, Calif.

[21] Appl. No.: 961,302

[22] Filed: Oct. 15, 1992

[51] Int. Cl.[5] ..... F02C 1/00

[52] U.S. Cl. ..... 60/722; 60/752; 431/353

[58] Field of Search ..... 60/39.827, 39.828, 722, 60/737, 738, 752, 753; 431/11, 245, 246, 350, 353

[56] References Cited

U.S. PATENT DOCUMENTS

| | | | |
|---|---|---|---|
| 2,626,655 | 1/1953 | Trautman et al. | 60/39.141 |
| 2,641,904 | 6/1953 | Bouffart | 60/722 |
| 2,682,148 | 6/1954 | Brierly | 60/752 |
| 2,698,050 | 12/1954 | Bloomer et al. | 60/753 |
| 3,012,402 | 12/1961 | Pzobert et al. | 60/722 |
| 3,434,012 | 3/1969 | Rademacher | 60/39.828 |
| 4,018,043 | 4/1977 | Clemmens | 60/756 |
| 4,077,761 | 3/1978 | Dollinger et al. | 431/353 |
| 4,197,831 | 4/1980 | Black | 431/353 |
| 4,401,099 | 8/1983 | Collier | 431/353 |
| 4,850,857 | 7/1989 | Obermuller | 431/242 |

FOREIGN PATENT DOCUMENTS

| | | | |
|---|---|---|---|
| 0954381 | 11/1956 | Fed. Rep. of Germany | 60/738 |

*Primary Examiner*—Richard A. Bertsch
*Assistant Examiner*—Michael I. Kocharov
*Attorney, Agent, or Firm*—W. K. Denson-Low

[57] ABSTRACT

A liquid fuel power plant (100) including an open-ended combustion chamber (102) and a first mechanism (114) for delivering a combustible fuel to the open-ended combustion chamber (102). A second mechanism (124) is included for igniting the fuel in the open-ended combustion chamber (102) and a concentric cylinder-shaped mechanism (130) is provided for extending the length of the combustion chamber (102) for decomposing the fuel to provide an exhaust gas comprised of fundamental elements. Finally, a third mechanism (202) is provided for using the exhaust gas to perform useful work. The air inlet line (122) delivers compressed air which is preheated in an air inlet passageway (194) and thereafter mixed with the combustible fuel in the open-ended combustion chamber (102). The residue of the combusted air-fuel mixture is thereafter forced by the compressed air into the concentric cylinder-shaped extension (130) which forms the reaction region (180) of the combustion chamber (102). The reaction region (180) becomes sufficiently hot to ensure complete decomposition of the hydrocarbon fuel. The hot pressurized exhaust gas, which is very low polluting, is directed by an exhaust tube (178) to a load (202) such as a turbine.

10 Claims, 3 Drawing Sheets

AIR COMPRESSOR
186
FROM COMPRESSOR DRIVE
188
100
122
190
178
TURBINE
178
192
178
196
184
202
184
176
194
194
176
136
134
132
2
2
196
182
130
104
120
124
194
118
106
110
112
194
102
117
114
116
FUEL PUMP
FROM FUEL SUPPLY

LIQUID FUEL POWER PLANT AND METHOD

BACKGROUND OF THE INVENTION

1. Field of the Invention

The present invention relates to power plants. More specifically, the present invention relates to methods and apparatus for a non-polluting power plant having a liquid fuel combustion chamber for the burning of hydrocarbon based fuels.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

2. Description of the Related Art

Many different types of liquid fueled power plants are known in the art for providing thrust to, for example, propel a projectile or drive a generator. Examples include liquid fueled jet engines, piston engines and rocket motors of various designs. Each of these liquid fueled power plant designs suffer from a number of problems during the launch and flight stages of the projectile or when driving the generator. The problems common to liquid fueled power plant designs include the generation of excessive amounts of noise and heat. Also, in the case of a liquid fueled rocket motor, large amounts of smoke can be generated which results in increased levels of atmospheric pollution.

Low detectability of a projectile during target approach is necessary in stealth operations. However, the generation of excessive noise during the launch and flight stages increases the probability that the projectile will be detected upon approach. Likewise, generation of large amounts of heat by the projectile can be detected by infrared sensors such as the forward looking infrared devices utilized by aircraft. The heat generated by the projectile can also be detected visually by utilizing night vision goggles. The smoke generated by certain liquid fueled rocket motors creates a visual smoke trail. Thus, the projectile is easier to track and the origin of the launch point is easier to determine. The density of the smoke trail is dependent upon the type of rocket motor fuel employed. Each of these problems increase the probability of projectile detection during approach to the target. Likewise, when driving a generator with, for example, a liquid fueled piston engine, the smoke exhaust from the engine increases the atmospheric pollution level.

Specific examples of liquid fueled power plant designs capable of providing thrust to propel a projectile include a liquid fueled turbine jet engine and a liquid fueled ram rocket motor. Turbine jet engines employing liquid fuel are known and are capable of providing thrust to propel a projectile and to provide rotational power to ground based power generator plants. In general, a turbine jet engine has a long cylindrical body and includes one or more liquid fuel burning chambers. The burning chamber is located at the center of the long cylindrical body and normally burns at temperatures in excess of three-thousand degrees Fahrenheit. The turbine jet engine includes multiple compression stages which produces a very high pressure in the burning chamber. When the liquid fuel is injected into the burning chamber, the fuel is combusted to provide hot, high pressure gases and enormous output horsepower.

The outer walls of the burning chamber are at a lower temperature than that of the flame at the center of the burner. Because of the temperature differential between the flame and the outer wall and the operating temperature of the burning chamber, the liquid fuel is not totally combusted. The liquid fuel is generally a hydrocarbon based fuel. When particles of a hydrocarbon based fuel are not totally burned, hydrocarbon based pollutants are produced. Further, since all of the liquid fuel is not totally combusted, the turbine jet engine is not fuel efficient. Additionally, the turbine jet engine is very noisy and produces excessive heat. Each of these characteristics of turbine jet engines increases the detectability of a projectile and the pollution level of the atmosphere.

The second example of a known liquid fueled power plant design capable of providing thrust to propel a projectile is a ram rocket motor. The ram rocket motor is a hybrid rocket motor generally having a short motor casing. The length of the motor casing is approximately three times the diameter of the rocket motor combustion chamber. The ram rocket motor burns liquid fuel which is injected into the combustion chamber along with compressed ambient air. The output of the combustion chamber is a hot pressurized gas which is directed to an impulse turbine blade that rotates a propeller or ducted fan. Ram rocket motors are normally utilized with air breathing missiles or any application that utilizes hot pressurized gas.

The combustion chamber of the ram rocket motor includes a device that provides a flame at the center of the rocket motor. Thus, the center of a ram rocket motor also operates at a temperature in excess of three-thousand degrees Fahrenheit. A high volume of air is forced through the rocket motor causing the temperature of the outer wall of the combustion chamber to be lower than the temperature at the center of the combustion chamber. The temperature differential between the center and the outer wall of the rocket motor results in incomplete combustion of some liquid fuel drops. This condition produces hydrocarbon and carbon pollution which is exhausted to the atmosphere. Therefore, liquid fueled rocket motors must be preheated to a specific temperature range to ensure total combustion of the fuel. Otherwise, a fuel efficiency problem results.

Further, the desired combustion temperature range of operation within the ram rocket motor is difficult to control. If the desired combustion temperature range is not maintained, the flame at the center of the combustion chamber is extinguished because of the length-to-diameter ratio of the motor casing. Further, ram rocket motors must be operated very hot and fuel rich to avoid extinguishing the combustion chamber flame. This situation results in fuel waste. Additionally, if the liquid fuel and compressed air are not properly mixed, residue smoke in the form of carbon particles appears in the exhaust gases. The smoke residue permits the projectile to be tracked. Finally, the ram rocket motor is very noisy which permits the projectile to be tracked by an audible sensor. Each of these characteristics of ram rocket motors increases the detectability of the projectile and the pollution level of the atmosphere.

A final example of a liquid fuel power plant design of the prior art is an incinerator employed for destroying hazardous waste. The incinerator includes a cylindrical combustion chamber joined by a flat circular plate to a smaller inlet pipe. Fuel nozzles protrude through the flat plate into the combustion chamber. The air and fuel are not premixed but rather are injected into the combustion chamber at the point of flame stabilization. Total combustion of the fuel occurs and low nitrous oxide ($NO_x$) levels are produced. Recirculation of the gas and air mixture is employed to ensure total combustion. The heat generated by the combustion is released to the atmosphere through a long hot exhaust tube that completes the decomposition of the hydrocarbon and carbon molecules.

Thus, there is a need in the art for further improvements in the design of liquid fueled power plants to reduce the detectability of and the exhausted pollutants from the power plants.

SUMMARY OF THE INVENTION

The need in the art is addressed by the liquid fuel power plant and method of the present invention. The invention includes an open-ended combustion chamber and a first mechanism for delivering a combustible fuel to the open-ended combustion chamber. A second mechanism is included for igniting the fuel in the open-ended combustion chamber and a concentric cylinder-shaped mechanism is provided for extending the length of the combustion chamber for decomposing the fuel to provide an exhaust gas comprised of fundamental elements. Finally, a third mechanism is provided for using the exhaust gas to perform useful work.

In a preferred embodiment, the liquid fuel power plant includes separate air and fuel input lines. The air input line delivers compressed air which is preheated in an air passageway and thereafter mixed with the combustible fuel in the open-ended combustion chamber. An igniter causes combustion of a compressed air-fuel mixture in the ignition region of the combustion chamber. The residue of the combusted air-fuel mixture is thereafter forced by the compressed air into the concentric cylinder-shaped extension which forms the reaction region of the combustion chamber. The reaction region becomes sufficiently hot to ensure complete decomposition of the hydrocarbon fuel. The hot pressurized exhaust gas, which is very low polluting, is directed by an exhaust tube to a load such as a turbine.

DESCRIPTION OF THE INVENTION

Figure 1:
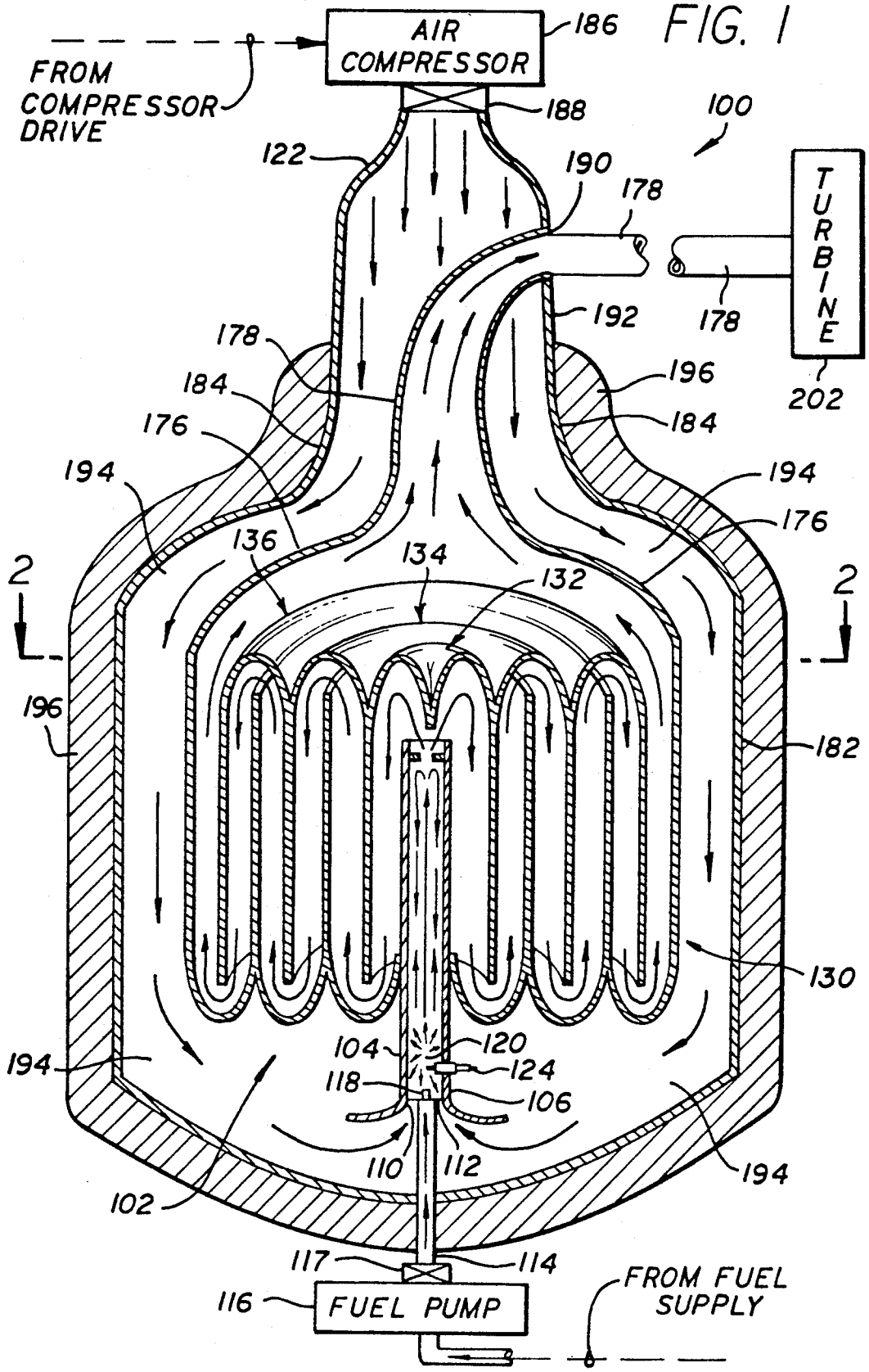
FIG. 1 is a simplified view, partly in section, in perspective and in block, of an illustrative embodiment of the liquid fuel power plant of the present invention showing a combustion chamber including an extension having a concentric construction.
Figure 1A:
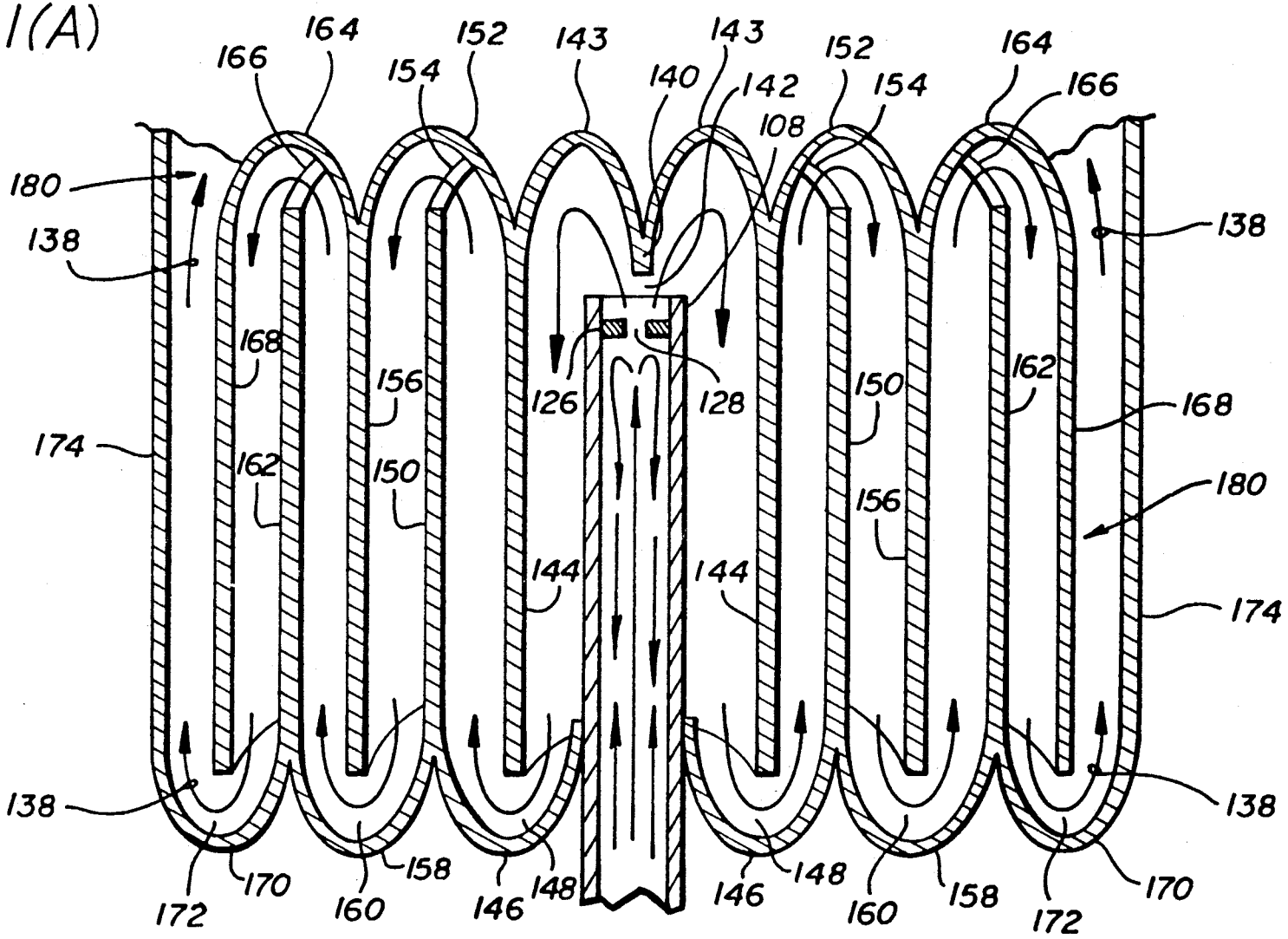
FIG. 1A is a cross-sectional view of the extension of the combustion chamber.

The invention is a liquid fuel power plant 100 as shown in FIG. 1. The power plant 100 includes an open-ended combustion chamber 102 which has no moving parts. The combustion chamber 102 preferably employed in the present invention includes a center chamber 104 as shown in FIG. 1. The center chamber 104 is a hollow, straight cylinder that serves as a mixing and ignition region for a fuel-air mixture.

The cylinder construction of the center chamber 104 includes a first end 106 and a second end 108. The first end 106 of the center chamber 104 includes a port 110 for receiving fuel and air. Positioned within the port 110 at the first end 106 is a device such as a bracket 112 for supporting a fuel feed line 114 carrying a combustible hydrocarbon based fuel. The fuel is fed from a fuel source (not shown) through the fuel feed line 114 by conventional methods such as, for example, by a fuel pump 116 and a gate control valve 117 as shown in FIG. 1. The gate control valve 117 is included to prevent the hot pressurized gases from backfeeding into the fuel line 114. The fuel feed line 114 terminates in a fine spray nozzle 118 for atomizing the fuel delivered to an ignition region 120 located within the center chamber 104.

The port 110 at the first end 106 of the center chamber 104 also serves as an inlet port for preheated compressed air or liquid oxygen. The compressed air or liquid oxygen is mixed in the correct proportions with the particular combustible fuel in the ignition region 120 of the combustion chamber 102. The compressed air or liquid oxygen each serve as an oxidizer to sustain the burning of the combustible fuel in the ignition region 120. In the embodiment of the liquid fuel power plant 100 shown in FIG. 1, the compressed air or liquid oxygen is provided by an air inlet line 122 as discussed hereinbelow.

Passing through the cylinder wall at the first end 106 of the center chamber 104 is an igniter 124. The igniter 124 functions to ignite the air-fuel mixture within the ignition region 120 therein. The igniter 124 can be one of several devices depending upon the hydrocarbon based fuel utilized in the power plant 100. For example, if a lightweight fuel such as natural gas, butane, propane or gasoline is employed, the igniter 124 can be a spark plug. For lightweight fuels, the spark plug is continuously energized. If a heavier fuel such as diesel is utilized, a spark plug continues to be the preferred igniter device. However, a glow plug can also be employed as the igniter device. A glow plug incorporates a platinum wire that is constantly energized and glows white hot to ensure burning of the air-fuel mixture. The igniter 124 is connected to an electrical circuit (not shown) to provide a spark for burning the air-fuel mixture.

The continuously energized igniter 124 causes the air-fuel mixture to be combusted in the center chamber 104. Thus, the center chamber 104 is referred as the ignition region 120. The combustion of the air-fuel mixture in the ignition region 120 results in the creation of hot pressurized gases which includes pollutants. The hot pressurized gases are forced to travel to the second end 108 of the center chamber 104 by the expansion of the compressed air in the air-fuel mixture. Located at the second end 108 is an air-flow turbulator 126 as shown in FIG. 1. The turbulator 126 exhibits a construction similar to a washer or disk having a center penetration 128 therethrough. The turbulator 126 is positioned across the width of the second end 108 of the center chamber 104 and serves to generate turbulence in the hot pressurized gases.

The flow of the hot pressurized gases through the center chamber 104 is interrupted by the turbulator 126. That portion of the hot pressurized gases not passing through the center penetration 128 of the turbulator 126 is temporarily delayed from exiting the center chamber 104. The delayed gases are forced to recirculate back to the ignition region 120 of the center chamber 104. Further exposure of the hot pressurized gases to the ignition region 120 ensures complete combustion of the air-fuel mixture. The distance between the spray nozzle 118 at the end of the fuel feed line 114 and the turbulator 126 must be a straight line as is shown in FIG. 1 to ensure proper recirculation and complete combustion of the gases. The ignition region 120 extends from the spray nozzle 118 and the turbulator 126.

The combustion chamber 102 further includes an extension 130. In the present invention as shown in FIG. 1, the combustion chamber extension 130 comprises a plurality of concentric cylinders. First, second and third concentric cylinders 132, 134 and 136, respectively, are shown for illustrative purposes only. The first concentric cylinder 132 is positioned at the center of the combustion chamber 102 and immediately surrounds the center chamber 104. The second cylinder 134 surrounds and is concentric with the first cylinder 132. Likewise, the third cylinder 136 surrounds and is concentric with both the first and second cylinders 132 and 134, respectively. Thus, the first cylinder 132 is nested within the second cylinder 134 and the second cylinder 134 is nested within the third cylinder 136 to provide a symmetrical structure.

The combustion chamber extension 130 is fabricated to provide a continuous pathway 138 through the combustion chamber extension 130. The continuous pathway 138 is provided in the following manner. Each of the first, second and third concentric cylinders 132, 134 and 136 is constructed to provide a hollow space within the respective cylinder to form a portion of the continuous pathway 138. The first concentric cylinder 132 includes an inner Wall 140 which terminates above the second end 108 of the center chamber 104 as shown in FIG. 1. A space 142 provided between the end of the inner wall 140 and the second end 108 of the center chamber 104 enables the hot pressurized gases from the center chamber 104 to enter the continuous pathway 138.

The inner wall 140 is extended to a top portion 143 of the first concentric cylinder 132 to form a wall 144. The wall 144 is common to both the first and second concentric cylinders 132 and 134, respectively, as shown in FIG. 1. In particular, common wall 144 serves as the outer wall of the first concentric cylinder 132 and also as the inner wall of the second concentric cylinder 134. The common wall 144 terminates above a bottom portion 146 of the first concentric chamber 132 to provide a space 148 that is part of the continuous pathway 138. The bottom portion 146 extends from the center chamber 104 to form a wall 150. Wall 150 passes upward through the center of the second concentric cylinder 134 and terminates prior to reaching a top portion 152 thereof as shown in FIG. 1. A space 154 is formed between the top portion 152 and the wall 150 that serves as part of the continuous pathway 138 for the passage of the hot pressurized gases.

The top portion 152 of the second concentric cylinder 134 is extended to form a wall 156. Wall 156 is common to both the second and third concentric cylinders 134 and 136, respectively as shown in FIG. 1. In particular, wall 156 serves as an outer wall for the second concentric cylinder 134 and as an inner wall for the third concentric cylinder 136. The wall 156 terminates above a bottom portion 158 of the second concentric cylinder 134 to form a space 160. The space 160 is a portion of the continuous pathway 138 for the passage of the hot pressurized gases generated within the center chamber 104. The bottom portion 158 of the second concentric cylinder 134 is extended to form a wall 162. Wall 162 passes upward through the center of the third concentric cylinder 136 and terminates prior to reaching a top portion 164 thereof as shown in FIG. 1. A space 166 is formed between the top portion 164 and the wall 162 that serves as part of the continuous pathway 138 for the passage of the hot pressurized gases.

The top portion 164 of the third concentric cylinder 136 is extended to form a wall 168. In the embodiment of FIG. 1, wall 168 serves as an outer wall of the third concentric cylinder 136. The wall 168 terminates above a bottom portion 170 of the third concentric cylinder 136 to form a space 172. The space 172 is also a portion of the continuous pathway 138 for the passage of the hot pressurized gases. The bottom portion 170 of the third concentric cylinder 136 is extended to form a wall 174. Wall 174 extends upward and surrounds the combustion chamber extension 130 and the second end 108 of the center chamber 104 as shown in FIG. 1. Thus, wall 174 serves as the combustion chamber outer wall. The combustion chamber outer wall 174 is joined with a combustion chamber cap 176 which, in turn, is connected to an exhaust tube 178 in a manner known in the art. Thus, the combustion chamber 102 is open-ended and provides a continuous pathway 138 between the second end 108 of the center chamber 104 and the exhaust tube 178 via the concentric cylinders 132, 134 and 136 for the hot pressurized gases.

The hot pressurized gases created from the combustion of the air-fuel mixture in the center chamber 104 interact with the turbulator 126. That portion of the hot pressurized gases that pass the turbulator 126 is directed to the combustion chamber extension 130. The hot pressurized gases enter the continuous pathway 138 and saturate each of the walls of the first, second and third concentric cylinders 132, 134 and 136, respectively. Thus, the temperature of the combustion chamber extension 130 is raised to approximately that of the center chamber 104. The concentric cylinder-shaped extension 130 effectively lengthens the combustion chamber 102 from (6"–8") to (3' to 5'). The length of the concentric cylinder-shaped extension 130 is dependent upon the dimensions of the combustion chamber 102 and on the type of fuel utilized. By lengthening the chamber 102 and by reusing the heat generated by the combustion, total burning of the air-fuel mixture and any hydrocarbon pollutants created in the chamber 102 is ensured. Lengthening the combustion chamber 102 via the extension 130 also prevents ignition termination (e.g., flame out) since the combustion can take place anywhere along the length of the extension 130.

The concentric cylinder-shaped extension 130 forms a "reaction region" 180 which is connected to the exhaust tube 178 as shown in FIG. 1. The reaction region 180 exists within the continuous pathway 138 and extends from the turbulator 126 to the exhaust tube 178. The hydrocarbon pollutants created in the ignition region 120 are either burned and disintegrated or are forced to decompose to the base elements in the reaction region 180 due to the presence of the heat. Thus, the concentric cylinder-shaped extension 130 functioning as a reaction region 180 expels pollution free gases to the exhaust tube 178 as shown in FIG. 1. The pollution free gases are thereafter directed to a mechanism for driving a load as described hereinbelow. Further, the reaction region 180 of the extension 130 enables the use of a very lean air-fuel mixture which improves the efficiency of operation.

The combustion chamber 102 including the center chamber 104 and the concentric cylinder-shaped extension 130 is formed of high temperature ceramic or metal and can withstand temperatures in excess of 3000 degrees Fahrenheit. The center chamber 104 and the extension 130 can be of unitary construction and thus is either completely ceramic or metal. An example of a suitable metal for use in forming the center chamber 104 and the extension 130 including each of the concentric cylinders 132, 134 and 136 is a nickel-steel based alloy. Likewise, the air-flow turbulator 126 and the exhaust tube 178 is either formed from ceramic or metal that is consistent with the material of the combustion chamber 102. In general, the nickel alloy construction is employed for lower temperature operations while the ceramic construction is utilized for higher temperature operations.

The entire combustion chamber 102 is located within an outer cylindrical wall 182 as shown in FIG. 1. The shape of the outer cylindrical wall 182 funnels down to form a neck portion 184. The neck portion 184 coincides with and is connected to the air inlet line 122 in a manner known in the art. The air inlet line 122 directs the compressed air or liquid oxygen into the liquid fuel power plant 100. The compressed air or liquid oxygen is provided by an air compressor 186 connected to the air inlet line 122 as shown in FIG. 1. The air compressor 186 is one of a variety known in the art and is operated by a drive mechanism such as, for example, a rotating drive shift (not shown). The compressed air inlet line 122 can include a gate control valve 188 to prevent the hot pressurized gases from backfeeding into line 122.

The exhaust tube 178 passes through the center of the air inlet line 122 in a concentric manner as shown in FIG. 1. The hot pressurized gases exiting the combustion chamber extension 130 causes the temperature of the exhaust tube 178 to be very high. The compressed air passes through the air inlet line 122 and contacts the exhaust tube 178 resulting in heat transfer from the exhaust tube 178 to the incoming compressed air. Thus, the exhaust tube 178 also serves to preheat the incoming compressed air to increase the efficiency of the combustion chamber 102. Thereafter, the exhaust tube 178 exits the air inlet line 122 by passing through an opening 190 in a sidewall 192 of the line 122. The opening 190 in the sidewall 192 of the air inlet line 122 is then sealed in a manner known in the art. The air inlet line 122, the exhaust tube 178 and the outer cylindrical wall 182 are each comprised from a material consistent with the material used in the combustion chamber 102. A nickel-steel based alloy can be used for applications to 2000 degrees Fahrenheit while ceramic can be utilized for applications at higher temperatures.

The preheated incoming compressed air then enters an air inlet passageway 194 formed between the combustion chamber outer wall 174 and the outer cylindrical wall 182. The air inlet passageway 194 completely surrounds the combustion chamber 102 and serves to contain and guide the preheated incoming compressed air into the first end 106 of the center chamber 104. The preheated compressed air or liquid oxygen is delivered to the ignition region 120 of the center chamber 104 to support the combustion of the fuel. The initial combustion of the fuel occurs in the ignition region 120.

Completely surrounding the outer cylindrical wall 182 is an outer heat shield 196. The outer heat shield 196 serves to prevent the loss of heat generated by the combustion within the chamber 102 by containing the heat. By containing heat normally dissipated to the environment, the efficiency of combustion in the chamber 102 is improved. The compressed air inlet line 122 which coincides with the neck portion 184 of the outer cylindrical wall 182 penetrates the top of the heat shield 196 as shown in FIG. 1. The heat shield 196 is comprised of any suitable material for preventing the flow of heat past the outer cylindrical wall 182 of the combustion chamber 102. An example of a suitable material for the heat shield 196 is porous ceramic of the type having a bubble construction that insulates heat.

Figure 2:
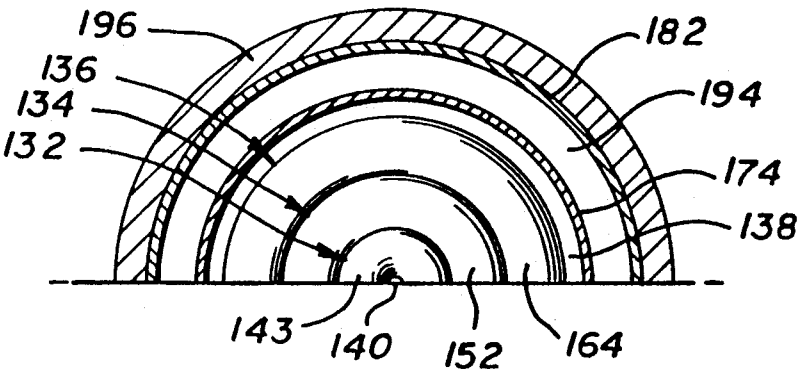
FIG. 2 is a cross-sectional view taken along the line 2—2 of FIG. 1 showing the concentric and symmetric construction of the nested cylinders within the outer cylindrical wall.

A cross-sectional view of the combustion chamber 102 showing the relationship between the combustion chamber extension 130, the combustion chamber extension outer wall 174, the outer cylindrical wall 182 and the outer heat shield 196 is shown in FIG. 2. Since FIG. 2 is a cross-sectional view of the cross-sectional view of FIG. 1, a semi-circle of the concentric cylinder-shaped extension 130 is shown. In particular, a planar view of the inner wall 140 is shown at the center of the diagram. Positioned concentrically about the inner wall 140 is the first, second and third cylinders 132, 134 and 136, respectively. The corresponding top portions 143, 152 and 164 of the first, second and third concentric cylinders 132, 134 and 136, respectively, are also shown. The top portions 143, 152 and 164 are shown to specifically illustrate that the first, second and third concentric cylinders 132, 134 and 136 each have a width dimension.

Located outside of the third concentric cylinder 136 is the combustion chamber extension outer wall 174 as shown in FIG. 2. Positioned in the space between the third concentric cylinder 136 and the combustion chamber extension outer wall 174 is a portion of the continuous pathway 138 for the passage of the hot pressurized gases generated by the combustion chamber 102. Located outside of the combustion chamber extension outer wall 174 is the outer cylindrical wall 182. The space located between the combustion chamber extension outer wall 174 and the outer cylindrical wall 182 is the air inlet passageway 194 utilized for the passage of the preheated input compressed air. Immediately outside and in contact with the outer cylindrical wall 182 is the outer heat shield 196 employed for insulating the heat generated by the combustion chamber 102.

During operation, the liquid fuel power plant 100 functions in the following manner. The combustible fuel is forced through the fuel feed line 114 by the fuel pump 116 to the spray nozzle 118. Simultaneously, the air compressor 186 delivers preheated compressed air to the port 110 via the air inlet passageway 194. The compressed air and atomized combustible fuel are mixed in the center chamber 104 as shown in FIG. 1. The air-fuel mixture is ignited by the igniter 124 resulting in combustion in the ignition region 120 of the center chamber 104. The small fuel droplets caused by atomizing the combustible fuel in the spray nozzle 118 results in higher efficiency ignition. The air-fuel mixture burns and generates hot expanding gases. The pressure of the hot expanding gases is derived from the pressure of the compressed air and the expansion of the air when the fuel is combusted.

As the present combustion of the air-fuel mixture takes place in the center chamber 104, the gases from the immediate previous combustion will be forced toward the reaction region 180 of the concentric cylinder-shaped extension 130 by the pressure of the expanding gases. The flow of the hot pressurized gases from the ignition region 120 is partially interrupted by the turbulator 126. The portion of the hot pressurized gases not passing through the turbulator penetration 128 is temporarily delayed from exiting the ignition region 120. The delayed gases are redirected to the ignition region 120 to ensure complete combustion of the air-fuel mixture. A portion of the expanding gases pass the turbulator 126 and travel into the concentric cylinder-shaped extension 130. The walls 144, 150, 156, 162, 168 and 174 of the first, second and third concentric cylinders 132, 134 and 136 of the extension 130 retain sufficient heat from the hot gases to ensure complete combustion or decomposition of the fuel and any residual pollutants before reaching the exhaust tube 178. The exhaust gases are, therefore, pollution free and can be controlled to produce useful work such as providing shaft power output from the power plant 100.

The combustion chamber 102 of the liquid fuel power plant 100 is operated within the temperature range of from 400 degrees Fahrenheit to 2000 degrees Fahrenheit. The exhaust gases are therefore within the low-to-medium temperature range while the pressure of the exhaust gases is within the low-to-medium pressure range (e.g., up to 100 PSI). This temperature range has been selected to ensure complete combustion of the fuel while avoiding production of nitrous oxides ($NO_x$). Operating temperatures above 2000 degrees Fahrenheit result in the production of higher nitrous oxides ($NO_x$) levels. By operating the combustion chamber 102 in the selected temperature range, the fuel will be completely combusted or decomposed to basic pollution free elements such as carbon, hydrogen and oxygen. Therefore, the combustion chamber 102 functions as a catalytic converter in the selected temperature range.

Any inexpensive fuel can be used in the combustion chamber 102 including diesel, kerosene, JP fuels and natural gas. By atomizing the combustible fuel in the spray nozzle 118, cheaper fuels that are otherwise difficult to burn can be utilized. By varying the proportions of compressed air and fuel, the proper mixture can be determined to ensure total combustion of the fuel. Total combustion means that all the energy in the fuel has been utilized. Each individual fuel will require an adjustment of the proportion of the compressed air utilized. After the correct mixture of air and fuel is achieved, less fuel will be necessary to generate the energy to accomplish a task than was previously required for other known power plants using the same fuel.

The liquid fuel power plant 100 of the present invention is a small, lightweight, multi-fuel non-polluting combustion engine in which the low-to-medium temperature and pressure exhaust gases are employed to operate a load. The combustion chamber 102 has no moving parts and is a stand-alone device that utilizes inexpensive hydrocarbon based fuels. The power plant 100 is very versatile in that it can be used for developing hot pressurized gases for use in, for example, an electrical generator, a turbine water pump, a recreational vehicle, a garden tractor, a battery charger, a small aircraft or a projectile. More specifically, when utilized with a turbine wheel to rotate a drive shaft, the power plant 100 provides inexpensive pollution free power to propel unmanned air vehicles or to operate an electrical generator to provide AC or DC voltage and current.

Figure 3:
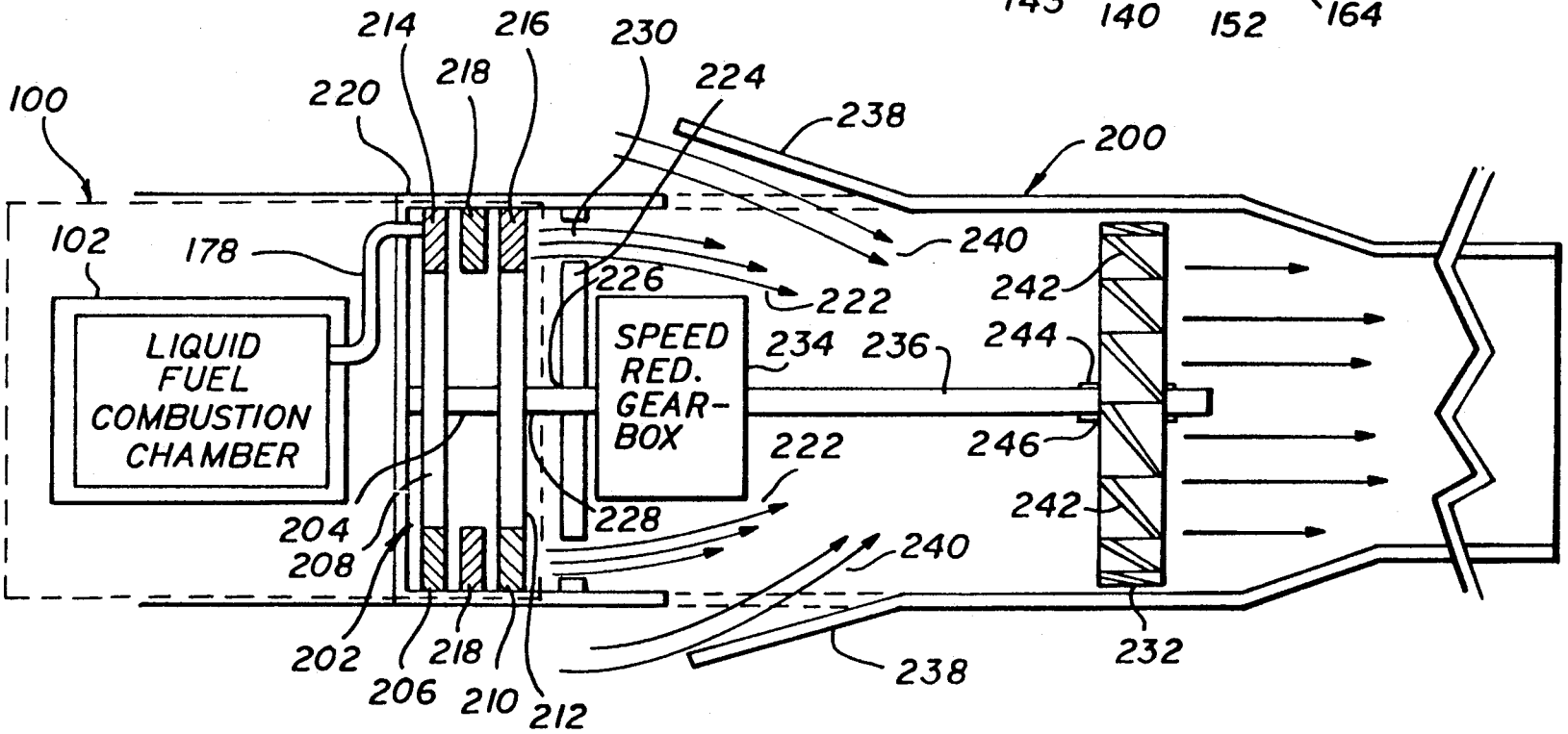
FIG. 3 is a simplified view, partly in section and partly in block, of an application of the liquid fuel power plant of the present invention showing the combustion chamber of FIG. 1 connected to the turbine within a typical projectile tube.

One of the many applications of the liquid fuel power plant 100 is shown in FIG. 3. The power plant 100 is shown located within a projectile 200 and is utilized to rotate a turbine 202 at high RPM. The exhaust tube 178 is connected between the end of the combustion chamber extension 130 and the turbine 202 as shown in FIG. 1. The pressurized gases generated by the combustion chamber 102 are directed through the exhaust tube 178 to spin the turbine 202 about a turbine axis 204 as shown in FIG. 3 and described hereinbelow. Note that it is also possible to connect the exhaust tube 178 of the combustion chamber 102 to a manifold (not shown) and then to connect a plurality of exhaust tubes from the manifold to the turbine 202. In either case, the pressurized gases are directed to the turbine 202 which is of a conventional design comprising one or more turbine blade wheels.

The turbine 202 of the power plant 100 shown in FIG. 3 depicts a two stage turbine for illustration purposes only. It is to be understood that a single stage turbine or a multiple stage turbine (e.g., greater than one stage) can also be utilized. In general, multiple stage turbines impart greater efficiency and horsepower. It is further noted that the pressure range of the hot gases produced by the power plant 100 is also dependent upon the number of turbine stages and the number and shape of the blades per turbine stage. The turbine 202 includes a first turbine stage 206 having a first rotating wheel 208 and a second turbine stage 210 having a second rotating wheel 212. The end of the first rotating wheel 208 includes a first set of turbine blades 214 and the end of the second rotating wheel 212 includes a second set of turbine blades 216. Positioned between the first and second sets of turbine blades 214 and 216 is a stationary set of blades 218 commonly referred to as stators. Stators are utilized to condition or redirect the gases for the next turbine stage.

The pressurized gases generated by the combustion chamber 102 are directed to the first turbine stage 206 by the exhaust tube 178. Since the first and second sets of turbine blades 214 and 216 are respectively connected to the first and second rotating wheels 208 and 212, then each set of turbine blades 214 and 216 also rotate. The pressurized gases initially strike the first set of turbine blades 214 which causes the first rotating wheel 208 of the first turbine stage 206 to rotate about the axis 204. The gases are then redirected to the stationary set of blades 218. The stationary set of blades 218 is mounted to an outer tube or metal housing 220 of the projectile 200 as shown in FIG. 3. In the example implementation, the shape of the stationary set of turbine blades 218 is opposed to that of the first and second sets of turbine blades 214 and 216. Thus, a function of the stationary set of blades 218 is to redirect and condition the gases from the output of the first rotating wheel 208 to the second turbine stage 210. The stationary set of blades 218 also orients the gases to the correct angle to achieve the maximum energy transfer to the second turbine stage 210.

The gases are then directed from the stationary set of blades 218 to the second set of turbine blades 216. When the gases strike the second set of turbine blades 216, the second rotating wheel 212 is caused to rotate about the axis 204. In general, the first turbine stage 206 is approximately 75% efficient while the second turbine stage 210 is approximately 10% efficient. A third turbine stage, if employed, would be approximately 5% efficient with the remainder of the energy in the pressurized gases being lost as heat energy. The density, temperature and pressure of the gases emitted from the exhaust tube 178 will determine the rotational speed in RPM of the turbine 202. As an example, a turbine wheel having a diameter of 5" and a drive shaft length of 4" and weighing approximately five pounds can be rated to provide a forty horsepower output.

The exhaust gases (indicated by numeral 222) expelled from the second turbine stage 210 will be at or near atmospheric pressure. This indicates that the first and second turbine stages 206 and 210 have absorbed almost all of the energy contained in the gases. Therefore, noise is not likely to be generated by the gases. This feature further minimizes the generation of noise in the entire power plant 100 making it more difficult to detect with audible detection devices. Thus, the power plant 100 is more attractive for use in stealth type devices.

The exhaust gases 222 are then directed from an exhaust region of the turbine 202 to a diffuser plate 224 as shown in FIG. 3. In the example implementation of the present invention, the diffuser plate 224 is a metallic plate mounted to the inside surface of the outer tube 220 of the projectile 200. The diffuser plate 224 includes a penetration 226 for the passage of a drive shaft 228. One of the functions of the diffuser plate 224 is to direct the exhaust gases out of the exhaust region of the turbine 202 through a passageway 230 to a load such as a ducted fan type propeller 232 positioned within the projectile 200. Another function of the diffuser plate 224 is to absorb additional energy from the gases. This action causes the gases to slow down further minimizing the noise generated by the power plant 100.

The rotating drive shaft 228 can be connected to a speed reduction gearbox 234 to achieve the proper rotational speed for the load attached to the power plant 100. The load is attached to the power plant 100 via an output drive shaft 236 extending from the speed reduction gearbox 234 as shown in FIG. 3. It is noted that the speed reduction gearbox 234 can be of a conventional design and is an optional feature that may not be necessary in a particular load application. A plurality of loads can be driven by the power plant 100. When the power plant 100 is utilized to propel the projectile 200, an appropriate load is the ducted fan type propeller 232 shown in FIG. 3.

The metal housing or outer tube 220 of the projectile 200 includes a vent flap 238 as shown in FIG. 3. The function of the vent flap 238 is to admit ambient air (indicated by the numeral 240) into the projectile 200. The ambient air 240 is drawn into the projectile 200 by the ducted fan type propeller 232. The ambient air 240 is then mixed with the exhaust gases 222 from the turbine 202 to dissipate the heat contained therein. The dissipation of the heat in the exhaust gases 222 makes the power plant 100 and the projectile 200 less vulnerable to detection by infrared type sensor devices. The ambient air and exhaust gas mixture is then fed to the ducted fan type propeller 232 to provide the thrust to propel the projectile 200.

The ducted fan type propeller 232 is internally located within the metal housing or outer tube 220 as shown in FIG. 3. The ducted fan type propeller 232 serves to provide the thrust to the projectile 200 by compressing (e.g., speeding up) the air as the air passes through the outer tube 220. Since the ducted fan type propeller 232 is located inside of the outer tube 220, it is usually of a small size. A plurality of fan blades 242 of the ducted fan type propeller 232 are shown in FIG. 3. The fan blades 242 are shown mounted to a center cog 244 having a center penetration 246 for accommodating the output drive shaft 236. The fan blades 242 serve to compress the air mixture. The number of fan blades 242 and the RPM at which they rotate provide a certain level of thrust to the projectile 200. The RPM of the fan blades 242 is directly related to the output of the turbine 202 and the speed reduction gearbox 234, if used.

Other examples of the utility of the present invention exist which include the liquid fuel power plant 100 as shown in FIG. 1 and in block form in FIG. 3. The power plant 100 interfaces with the turbine 202 and the drive shaft 228 as described above. However, the ducted fan type propeller 232 is replaced by other loads. For example, the load can be a DC or an AC electrical generating device (not shown) used to provide power to other electrical loads. Thus, a variety of loads can be substituted for the ducted fan type propeller 232.

Thus, the present invention has been described herein with reference to a particular embodiment for a particular application. Those having ordinary skill in the art and access to the present teachings will recognize additional modifications, applications and embodiments within the scope thereof. Although the detailed description is directed to a turbine driven air vehicle application, the liquid fuel power plant 100 of the present invention is equally applicable to driving a generator or similar device.

It is therefore intended by the appended claims to cover any and all such modifications, applications and embodiments within the scope of the present invention.

Accordingly,

What is claimed is:

1. A liquid fuel power plant comprising:

a elongated cylindrical center combustion chamber having a first end and a second end, said first end receiving combustible liquid fuel and an oxidizer, said second end having an outlet for exhausting hot pressurized gases from said elongated cylindrical center combustion chamber, said elongated cylindrical center combustion chamber having an ignition region in which the fuel and the oxidizer are ignited and having means for igniting said fuel in said ignition region, the fuel being ignited in said ignition region to produce hot pressurized gases in said elongated cylindrical center combustion chamber;

means for delivering said combustible liquid fuel to said ignition region;

means for delivering said oxidizer to said ignition region;

a plurality of concentric annular chambers including at least two inner annular concentric chamber including a first annular chamber having an inlet and an outlet, a portion of the length said elongated cylindrical center combustion chamber disposed in the central opening of said first annular shaped chamber with the outlet of the central annular chamber being in communication with the inlet of said first annular chamber to allow said hot pressurized gases to flow into said first annular chamber; and a second annular chamber having an inlet and an outlet, said first annular chamber disposed in the central opening of the second annular chamber with the outlet of said first annular chamber being in communication with the inlet of said second annular chamber to allow said hot pressurized gasses to flow into said second annular chamber; and an outer most annular chamber having an inlet and an outlet, said outermost annular chamber having the inner annular chambers disposed in its central opening with the outlet of the adjacent inner annular chamber being in communication with the inlet of said outer most annular chamber, said plurality of concentric annular chambers providing a reaction region for further combustion of said hot pressurized gases received from said elongated cylindrical combustion chamber, said further combusted hot pressurized gases being exhausted at the outlet of said outer most annular chamber.

2. A liquid fuel power plant as recited in claim 1 further comprising means for generating turbulence in the hot pressurized gases in the elongated cylindrical center combustion chamber said means for generating turbulence being disposed adjacent the outlet of said elongated cylindrical center combustion chamber.

3. A liquid fuel power plant as recited in claim 2 wherein said means for generating turbulence comprises a disk disposed across the outlet of said elongated cylindrical center combustion chamber, said disk having a center regeneration allowing passage of hot gases from the said elongated cylindrical center combustion chamber into said first annular chamber.

4. A liquid fuel power plant as recited in claim 1 further comprising heat shield means disposed for retaining heat in said elongated cylindrical center combustion chamber and said plurality of concentric annular chambers .

5. A liquid fuel power plant as recited in claim 4 wherein said means for delivering said oxidizer to said ignition region includes said heat shield means being disposed away from said elongated cylindrical center combustion chamber and said plurality of annular chambers to provide a passage way for heating pressurized air from an air inlet line.

6. A liquid fuel power plan as recited in claim 2 wherein the inlets and outlets of said plurality of concentric annular chambers are annular in shape.

7. A liquid fuel power plant as recited in claim 6 wherein the annular inlets and outlets are at opposite ends of the concentric annular chambers in adjacent chamber.

8. A liquid fuel power plant as recited in claim 1 wherein the cylindrical side wall of said elongated cylindrical center combustion chamber forms the inner wall of said first annular chamber; and wherein the inner side wall of said second annular chamber is formed by the outer side wall of said first annular chamber; and wherein the inner side wall of the outer most annular chamber is formed by the outer side wall of the adjacent annular chamber.

9. A liquid fuel power plant as recited in claim 8 further comprising heat shield means disposed for retaining heat in said elongated cylindrical center combustion chamber and said plurality of concentric annular chambers.

10. A liquid fuel power plant as recited in claim 9 further comprising means for generating turbulence comprising a disk disposed across the outlet of said elongated cylindrical center combustion chamber, said disk having a center penetration allowing passage of hot gases from the said elongated cylindrical center combustion chamber into said first annular chamber.

* * * * *